US005645001A

United States Patent [19]

Green et al.

[11] Patent Number: 5,645,001

[45] Date of Patent: Jul. 8, 1997

[54] LINEAR MOTION LOOPER APPARATUS FOR TUFTING MACHINE

[75] Inventors: Jerry Green, Signal Mountain; Michael E. Shipley, Soddy-Daisy; Richard J. Prichard, Hixson, all of Tenn.

[73] Assignee: Tuftco Corp., Chattanooga, Tenn.

[21] Appl. No.: 653,152

[22] Filed: May 24, 1996

[51] Int. Cl.[6] ..... D05C 15/24; D05C 15/22

[52] U.S. Cl. ..... 112/80.55; 112/80.5

[58] Field of Search ..... 112/80.01, 80.5, 112/80.55, 80.6

[56] References Cited

U.S. PATENT DOCUMENTS

| | | | |
|---|---|---|---|
| 3,633,523 | 1/1972 | Card . | |
| 3,919,953 | 11/1975 | Card et al. . | |
| 4,187,788 | 2/1980 | Cobble | 112/80.55 X |
| 4,301,752 | 11/1981 | Ingram . | |
| 4,375,196 | 3/1983 | Beasley | 112/80.55 X |
| 4,759,199 | 7/1988 | Prichard | 112/80.5 |
| 5,495,815 | 3/1996 | Bagnall | 112/80.5 |

*Primary Examiner*—Paul C. Lewis

*Attorney, Agent, or Firm*—Douglas T. Johnson

[57] ABSTRACT

A looper apparatus for a multiple needle tufting machine including a looper support member having a transverse hook bar for supporting a plurality of looper hooks for a cooperation with the reciprocable needles in the tufting machine and an elongated guide member reciprocably supported in linear bearings to restrict the motion of the looper hooks in a straight linear direction substantially parallel to the feeding direction to the base fabric, and a drive mechanism pivotally connected to hook support member for reciprocably driving the support member in a linear path. A stub shaft with thrust bearing is mounted at one end of the tufting machine and connected by a curved rocker arm to an end of the hook bar to offset knife pressure placed against the hooks and communicated to the hook bar.

16 Claims, 7 Drawing Sheets

LINEAR MOTION LOOPER APPARATUS FOR TUFTING MACHINE

BACKGROUND OF THE INVENTION

This invention relates to a looper apparatus for a tufting machine, and more particularly to a looper apparatus for imparting linear motion to the looper hooks. Previous looper configurations for tufting machines have generally been designed to impart limited arcuate, reciprocable motion to the looper hooks, whether they are cut pile hooks or loop pile hooks.

The looper apparatus which is predominantly used in commercial tufting machines today includes a looper bar supporting the looper hooks and in turn supported upon a curved rocker arm, the lower end of which is journaled about an idler or looper shaft. Reciprocable motion is imparted to the curved rocker arm by a reciprocable looper shaft or rock shaft which is reciprocably driven, and which is pivotally linked to the rocker arm. The degree of arcuate motion of the looper hooks is determined by the radial distance between the looper hooks and the axis of the lower idler shaft. In order to minimize the curvature of the arcuate travel of the looper hooks, the idler shaft must be located as far away from the looper hooks as possible in order to increase the radius. This involves locating the idler shaft as low as possible in the machine and maintaining the idler shaft in substantial vertical alignment with the reciprocal path of the needles.

The greater the radial distance between the looper hooks and the axis of the idler shaft, the greater the mass of the rocker arm and other cooperative elements. The greater the mass of the moving parts, the greater energy requirements for driving the rocker arm, the greater opportunity for vibration of the moving parts, and the greater is the obstruction in the lower part of the machine to maintain and service the machine.

Some representative examples of prior art tufting machines incorporating the above described looper apparatus including a rocker arm for driving the loop pile hooks are U.S. Pat. Nos. 3,633,523 by Card; 3,919,953 by Card et al.; 4,301,752 by Ingram, et al.; and 4,369,720 by Beasley.

In U.S. Pat. No. 4,759,199, an attempt was made to develop a linear motion looper apparatus for a tufting machine. Although this apparatus operated satisfactorily for limited sample runs, in actual commercial operation, the bearings wore out too quickly for satisfactory operation. The present invention is addressed primarily to overcoming the shortcomings of the machine described in U.S. Pat. No. 4,759,199.

SUMMARY OF THE INVENTION

It is therefore an object of this invention to provide a tufting machine having a looper apparatus for moving the looper hooks in a reciprocal, substantially straight linear path for cooperation with the corresponding needles to produce a uniform level of tufting.

Another object of this invention is to provide a looper apparatus for tufting machine which will minimize the vibration of the moving parts in the looper apparatus.

Another object of the present invention is to provide a looper apparatus that will permit the tufting of cut pile carpets with a very regular or even finish, thereby avoiding the necessity of tip shearing and producing a more attractive carpet.

Another object of this invention is to provide a looper apparatus for a tufting machine in which the moving parts have less mass than the moving parts of conventional looper apparatus.

A further object of this invention is to provide a looper apparatus for a multiple needle tufting machine with fewer parts occupying the space directly beneath the needles, and to create more room in the lower portion of the tufting machine to facilitate maintenance and service of the looper elements, and in the case of a cut pile tufting machine, the cutting elements.

Another object of this invention is to provide a looper apparatus for a multiple needle tufting machine permitting operation of the tufting machine at higher speeds.

Yet another object of the invention is to provide a linear motion looper apparatus with sufficient durability for efficient commercial usage.

The looper apparatus for a multiple needle tufting machine made in accordance with this invention includes a hook support member comprising a transverse hook bar upon which are mounted a plurality of conventional looper hooks for cooperation with the needles, and a plurality of elongated guide members or guide rods reciprocably supported in linear bearings to restrict the movement of the hook bar and looper hooks to a straight longitudinal path substantially parallel to the feed direction of the base fabric. A stub shaft with thrust bearing is connected to the hook bar to counterbalance the knife shaft pressure against the hook bar. A linearly movable hook support member is driven through pivotal linkage by reciprocal rotary hook shaft or jack shaft in time relation with the reciprocal needles and the movement of the base fabric, and also with the reciprocal movement of the knives in a cut pile tufting machine.

DESCRIPTION OF THE PREFERRED EMBODIMENT

Figure 1:
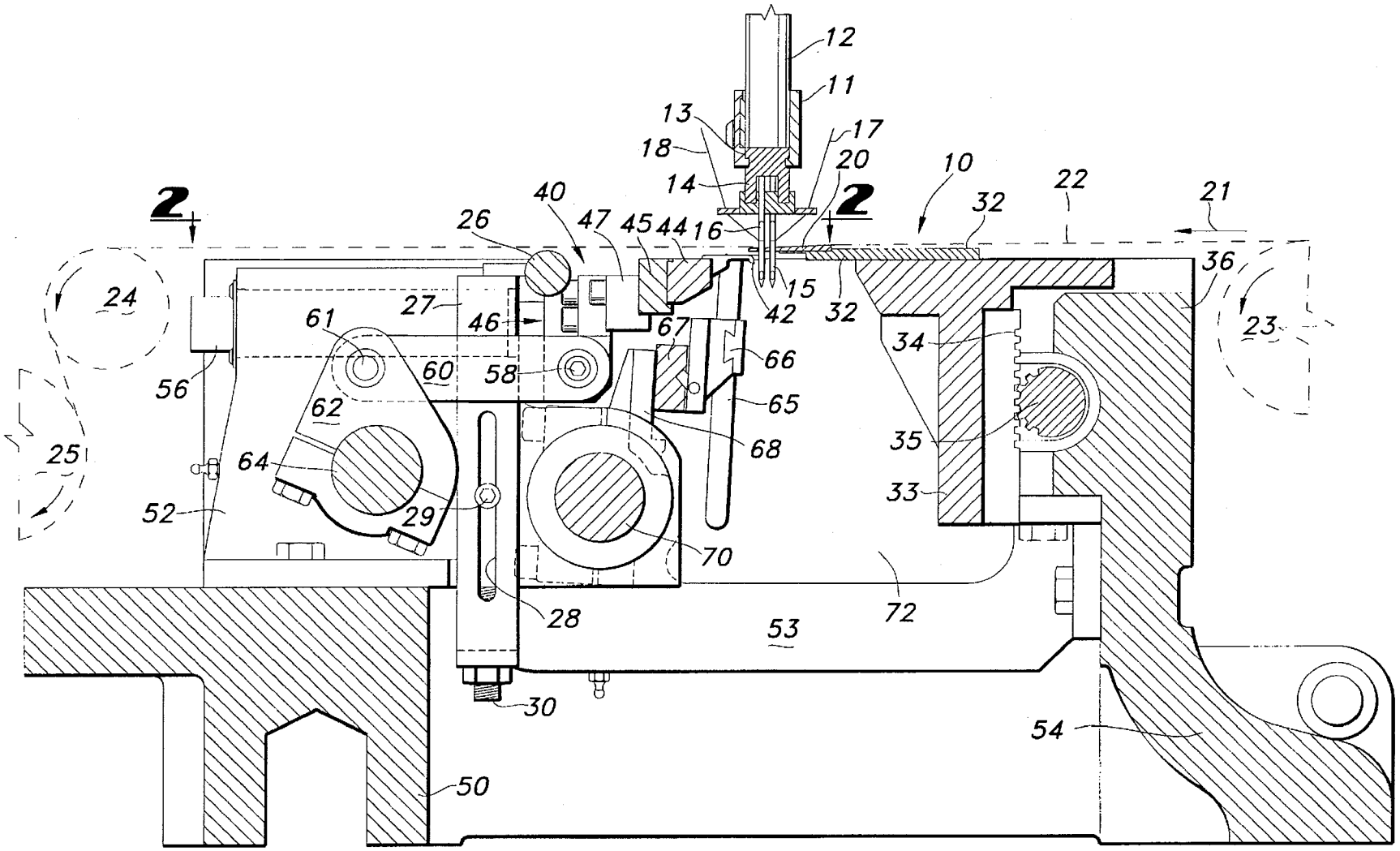
FIG. 1 is a fragmentary sectional elevation of a portion of a cut pile tufting machine incorporating a looper apparatus made in accordance with this invention and illustrating the looper hooks in a retracted, inoperative position.

Referring now to the drawings in more detail, FIG. 1 discloses a multiple needle cut pile tufting machine 10 including a transverse needle bar holder 11 fixed to a vertically reciprocable push rod 12 and including a transverse slide groove 13 for transversely slidably receiving the needle bar 14. The needle bar 14 is illustrated as supporting a plurality of transversely staggered front needles 15 and rear needles 16. Each of the front needles 15 is supplied with a yarn 17, while each of the rear needles 16 is supplied with a yarn 18 from yarn supply means, not shown.

The push rod 12 is adapted to be vertically driven by needle drive means, not shown, in a conventional manner.

Figure 4:
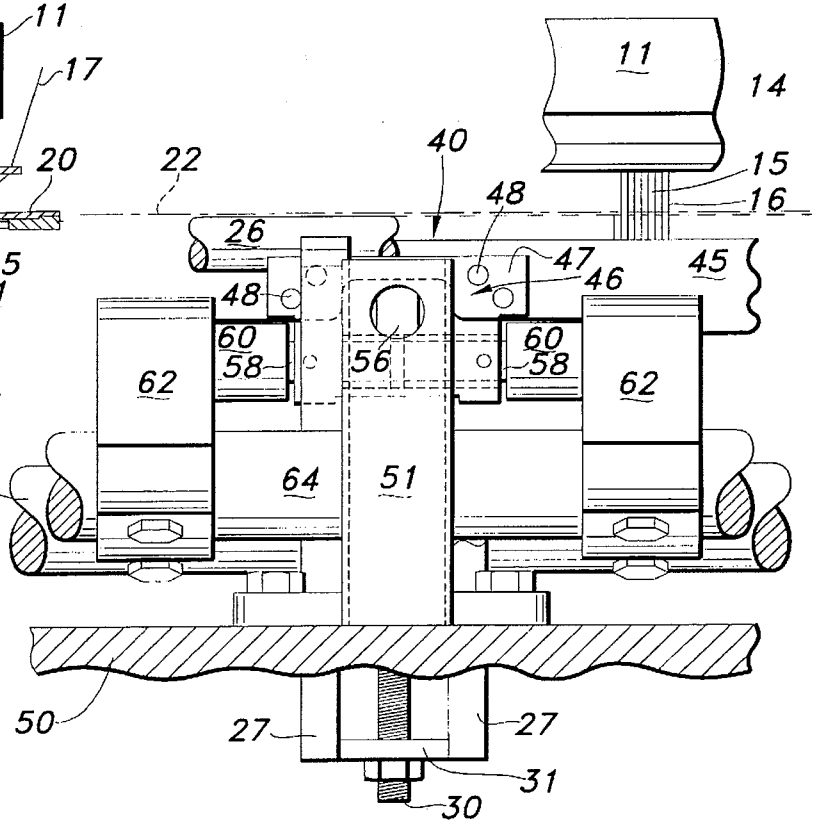
FIG. 4 is a fragmentary rear elevational sectional view taken along the line 4—4 of FIG. 3, with portions broken away.

Supported upon a needle plate 20 for longitudinal movement from front-to-rear in a feeding direction, indicated by the arrow 21, through the tufting machine 10 is a base fabric 22. The base fabric 22 is fed in the feed direction 21 by the fabric feed rolls 23, 24, and 25 in a conventional manner. Moreover, the base fabric 22 may also be supported upon the transverse fabric support bar 26, if desired. The transverse fabric support bar 26 is mounted on standards 27 having elongated slots 28 therein for receiving fixed guide pins or bolts 29 fixed to the frame of the machine 10. The elevation of the fabric support bar 26 may be adjusted by means of the adjustment bolt 30 extending through a corresponding aperture in the bottom frame bar 31 (shown in FIGS. 3 and 4) and threadedly secured in a corresponding opening in the bottom of the frame of the machine 10, all in a conventional manner.

The needle plate 20 is supported upon a mounting plate 32 and frame 33 which includes a vertical rack 34 operatively engaging a gear 35 rotably mounted within the bed frame 36. By rotating the gear or gears 35 by conventional means such as a dial or a servo motor, not shown, the needle plate 20 is vertically adjusted to the proper elevation for supporting the base fabric 22.

The needle plate 20 and the fabric support bar 26 are preferably vertically adjusted so that that portion of the support bar 26 generally supports the base fabric 22 in a horizontal plane and in a position to be penetrated by the needles 15 and 16 on the downstroke of the needle bar 14.

The looper apparatus 40 made in accordance with this invention includes a plurality of first long cut pile hooks 41 (shown in FIG. 3) alternating with a plurality of second short cut pile hooks 42, all of which are preferably uniformly spaced, but in any event, spaced on gauge with the needles 15 and 16 within corresponding slots, not shown, in the hook bar 44 so that each of the cut pile hooks 41 and 42 may cooperate with the corresponding needles 15 and 16 in a conventional manner in a tufting area, for seizing the yarns 17 and 18 respectively carried through the base fabric 22 in order to form corresponding loops. It will be understood that many alternative arrangements of hooks and needles are possible, including the use of dual shiftable needle bars and hooks of equal length, as the particular looper configuration is not critical to the present invention.

Figure 2:
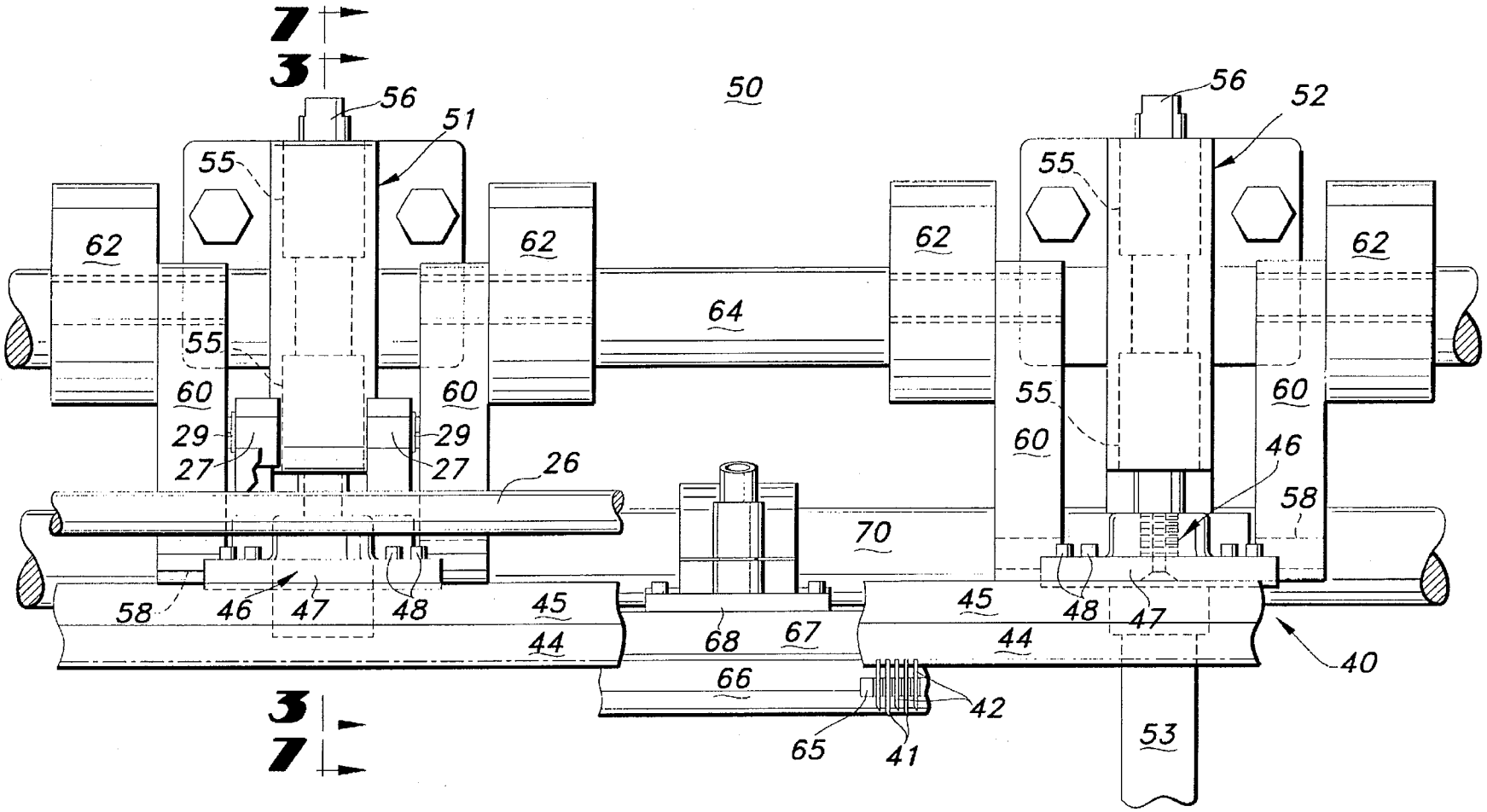
FIG. 2 is an enlarged fragmentary plan section taken along the line 2—2 of FIG. 1 with portions broken away.

The hook bar 44 is elongated transversely and may be made in sections, if desired. The hook bar 44 is secured in a transversely extending hook mounting bar 45, which in turn is supported upon a plurality of transversely spaced drive blocks or heads 46, two of which are shown in FIG. 2. Each drive block 46 is provided with an upper flange 47 to fit flush against the rear of the hook mounting bar 45 and is provided with a plurality of holes to receive bolts 48 (shown in FIGS. 2 and 3) for attaching the drive block 46 to the mounting bar 45.

Figure 6:
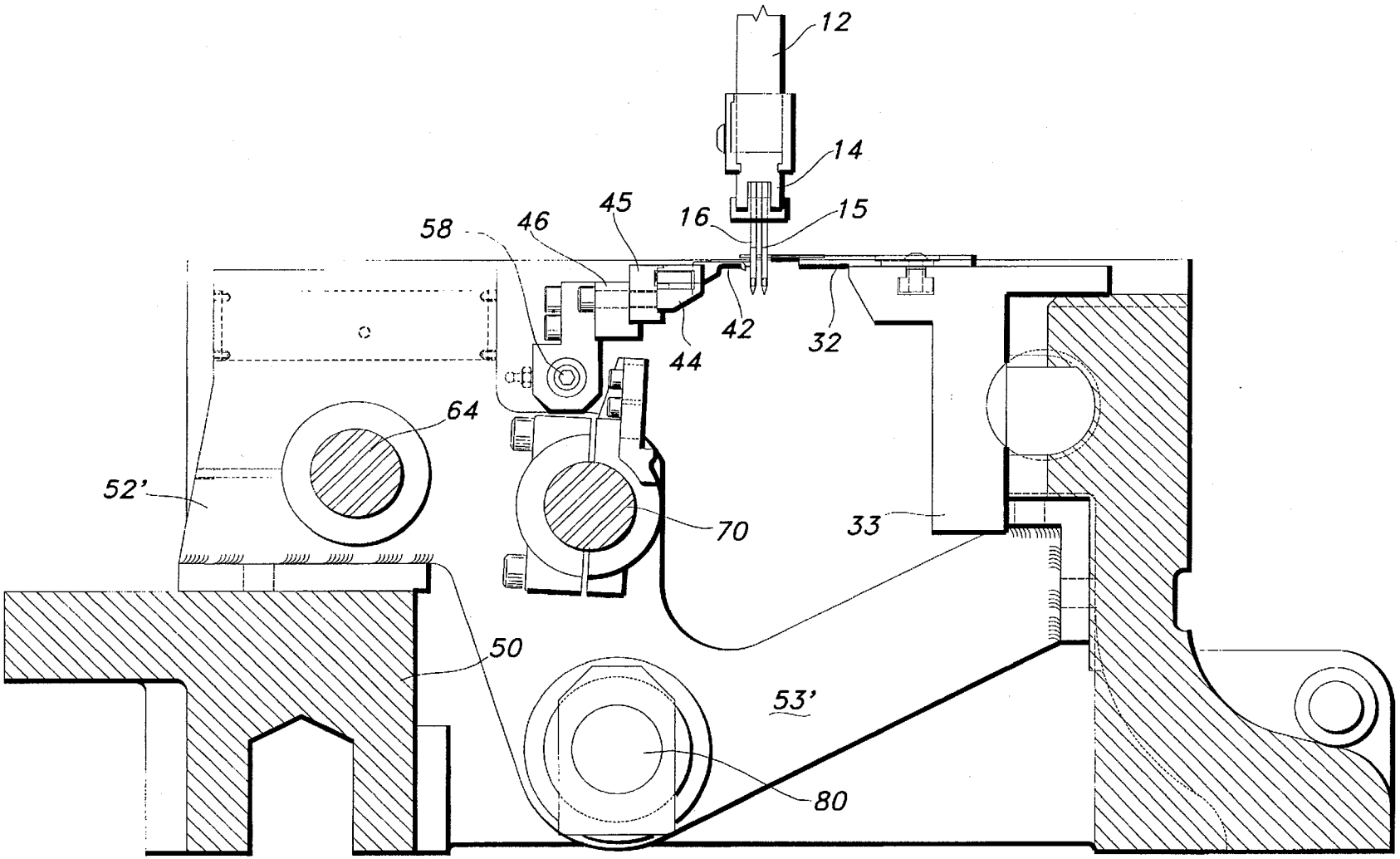
FIG. 6 is a fragmentary sectional elevation of a portion of a tufting machine incorporating a looper apparatus made in accordance with this invention illustrating the cross member for the thrust support bearing.

Mounted upon the machine frame 50 at transversely spaced intervals are a plurality of bearing support blocks 51 and 52. Each of the bearing support blocks 52 is provided with a longitudinal cross member 53 for extending from the front to the rear portion of the frame for added support. The first cross member 53', illustrated in FIG. 6 is specially configured to support a stub shaft 80 according to the present invention.

Figure 3:
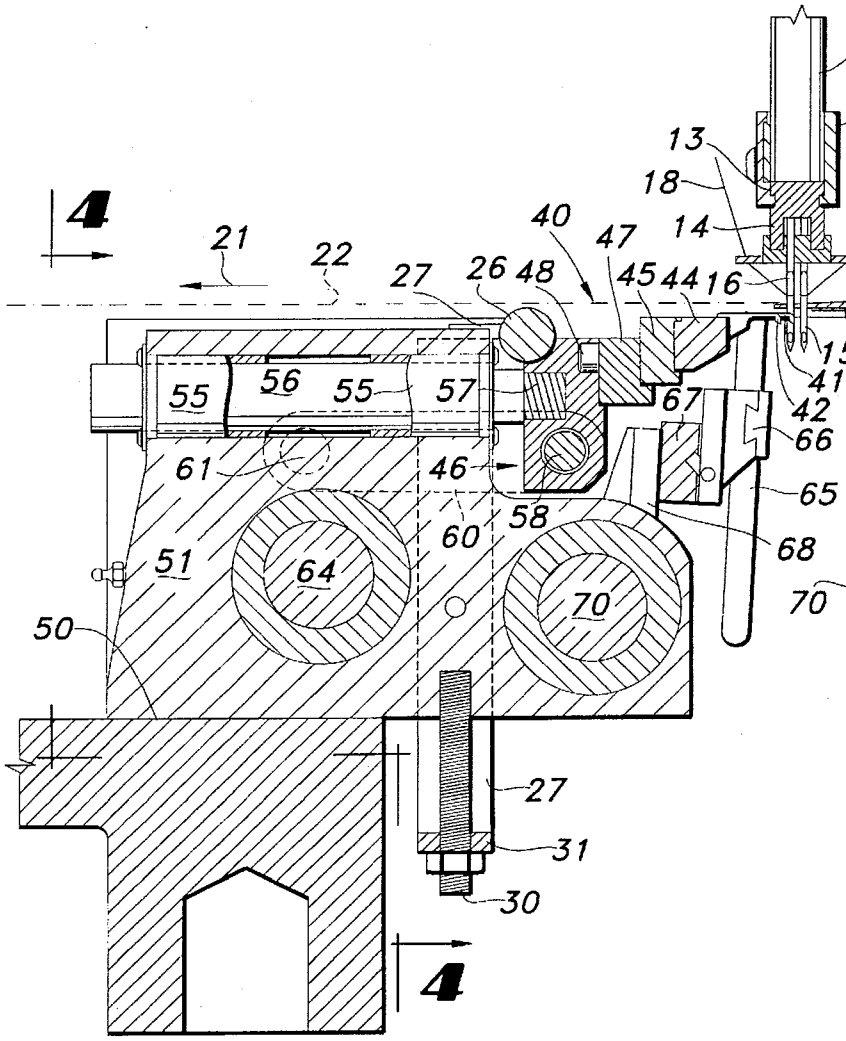
FIG. 3 is a fragmentary sectional elevation taken along the line 3—3 of FIG. 2.

Turning now to FIG. 2, it will be seen that each of the bearing support blocks 51 and 52 is provided with a pair of front-to-rear longitudinally spaced linear bearings 55 slidably receiving an elongated guide member or guide rod 56. The linear bushings or bearings 55 are preferably of the re-circulating ball bushing type, such as "Thomson bearings". The front end portion 57 of each guide rod 56 is threaded to be threadably received within a corresponding socket within the body of the drive block 46, as shown in FIG. 3. The length of the guide rod 56 is great enough that it will always be retained in the two front and rear linear bearings 55 regardless of the extent of the longitudinal travel of the hook bar 44.

Journaled to the opposite sides of the lower portion of the body of the drive block 46 by pivot pins 58 are the front end portions of link bars 60. The rear end portions of the link bars 60 are journaled by pivot pins 61 (shown in FIG. 1) to corresponding radial arm members 62 fixed on opposite sides of each of the bearing support blocks 51 or 52 to a driven reciprocable rotary looper or jack shaft 64. The rear pivot pin 61 is radially spaced from the rotary axis of the looper shaft 64 to impart linear motion to the guide rod 56 from the rotary motion of the looper shaft 64. The looper shaft 64 is driven to reciprocate in a limited rotary movement by conventional drive means, not shown. Moreover, the drive means for the looper shaft is synchronized with the needle drive means for the push rod 12.

As shown in FIG. 3, adapted to cooperate with each of the cut pile hooks 41 and 42 is a knife 65 mounted in a knife holder 66 supported upon a transverse knife block 67, which in turn is supported upon a knife bracket 68 (shown in FIG. 1) fixed to the reciprocably rotatable transverse knife shaft 70. Knife shaft 70 is tensioned axially so that knives 65 press against corresponding hooks 41, 42, typically such tension being provided by at least one thrust bearing, not shown.

It will be understood that it is also within the scope of this invention to utilize the looper apparatus 40 for in-line needles, or dual shiftable needle bars, as well as the staggered needles 15 and 16 disclosed in the drawings.

As disclosed in FIG. 1, the needle bar 14 is slidably mounted transversely within the needle bar holder 11 to permit transverse reciprocable movement by virtue of the conventional needle bar shifting mechanism. The looper apparatus 40 may also be used in connection with a needle bar without the shifting capability.

Figure 7:
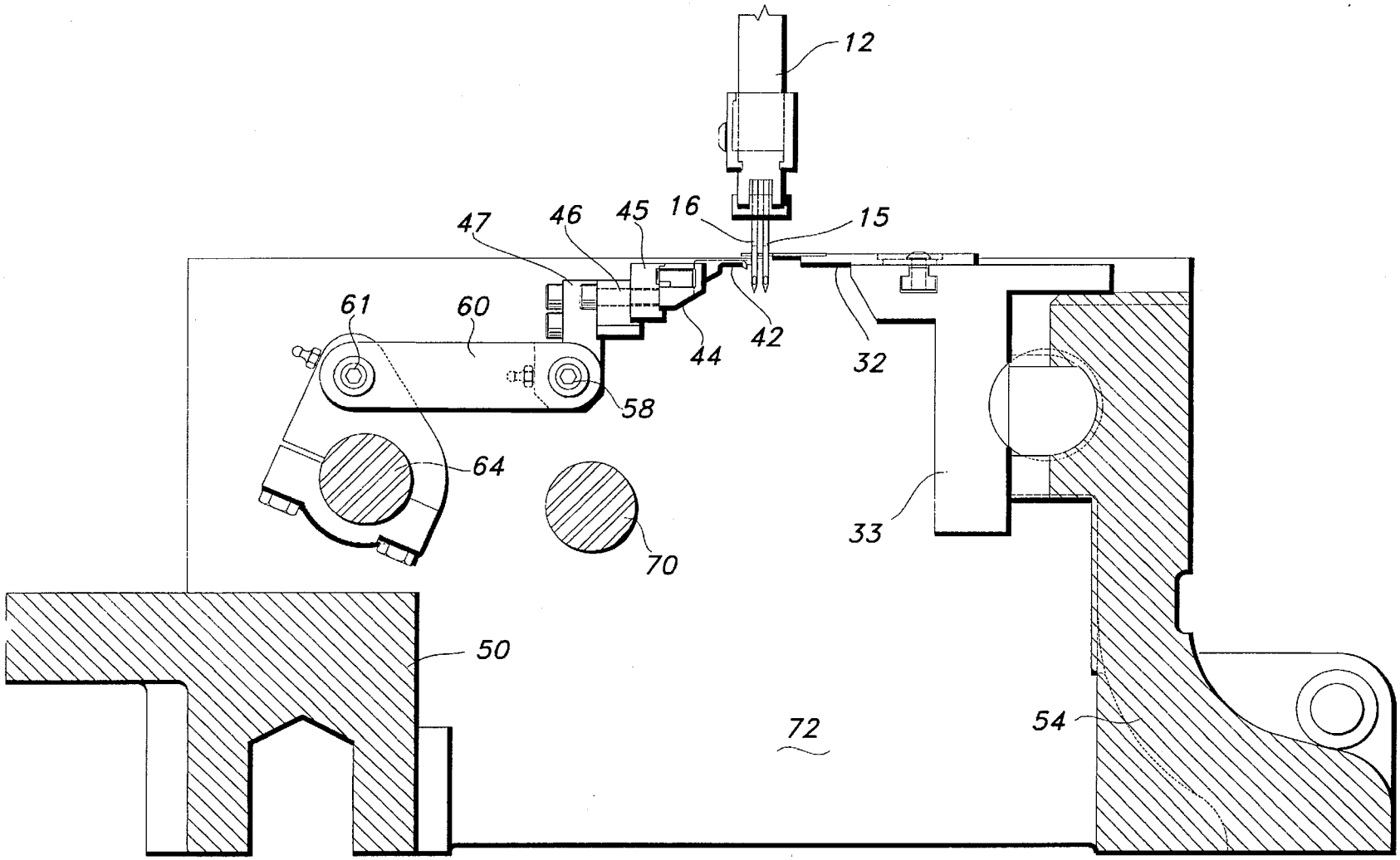
FIG. 7 is a fragmentary sectional elevation of a portion of a tufting machine incorporating a looper apparatus made in accordance with this invention taken along a line in between cross members, illustrating the accessibility of the looper apparatus from beneath the machine.

By virtue of the utilization of the looper apparatus 40 made in accordance with this invention, a substantial space 72 (shown in FIG. 7) is provided in the tufting machine 10 below the needle mounting plate 32 and between the knife shaft 70 and the front portion of the machine frame 54, this space 72 extends all the way to the floor between the cross members 53. Thus, a considerable amount of room is provided in the lower portion of the tufting machine 10 to permit access to the moving parts of the looper apparatus 40 and the knives 65 and their supporting elements for service, maintenance, and replacement of parts.

Furthermore, it will be noted that the looper apparatus 40 incorporates parts whose mass is substantially less than the mass of the moving parts of a conventional looper apparatus, including the long arcuate rocker arms.

The principal use of a linear motion looper apparatus of this construction is in a tufting machine adapted to produce cut pile tufts because it is the driving of both cut pile hooks and knives that so restricts the space beneath a conventional tufting machine. However, it has been found that the pressure applied by knives 65 tensioned against cut pile hooks 41, 42 causes hook bar 44 to transmit such great lateral pressure against linear bearings 55, that conventional linear bearings 55 quickly fail during tufting operations. For instance approximately 7000 pounds of tension is transmitted to the hook bar 44 on a four meter ⅛ inch gauge cut pile tufting machine. Longer or finer gauge machines must bear even greater tensions.

Figure 5:
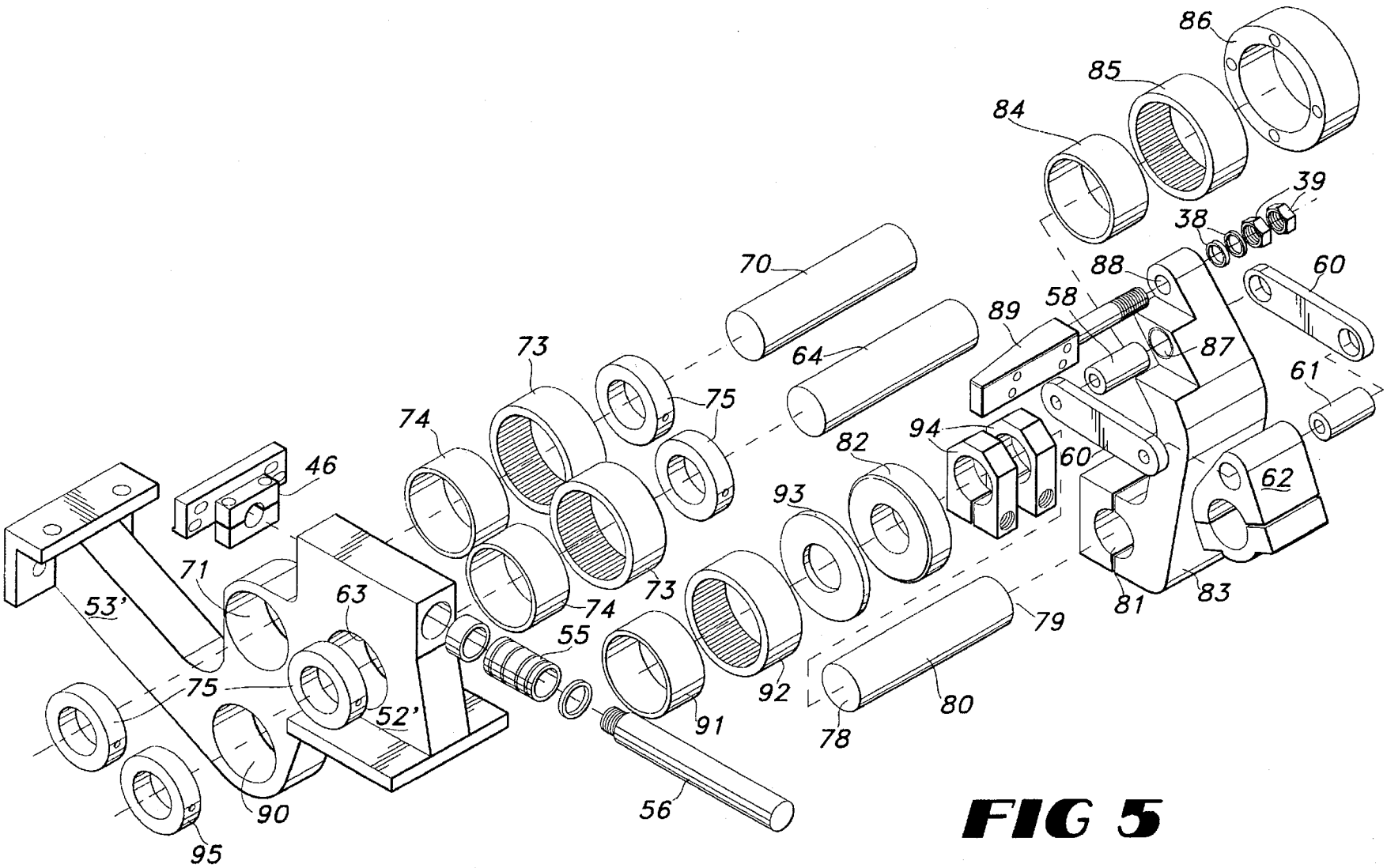
FIG. 5 is an exploded perspective view of the shaft assemblies of a cut pile tufting machine incorporating the present invention in the form of a stub shaft.
Figure 8:
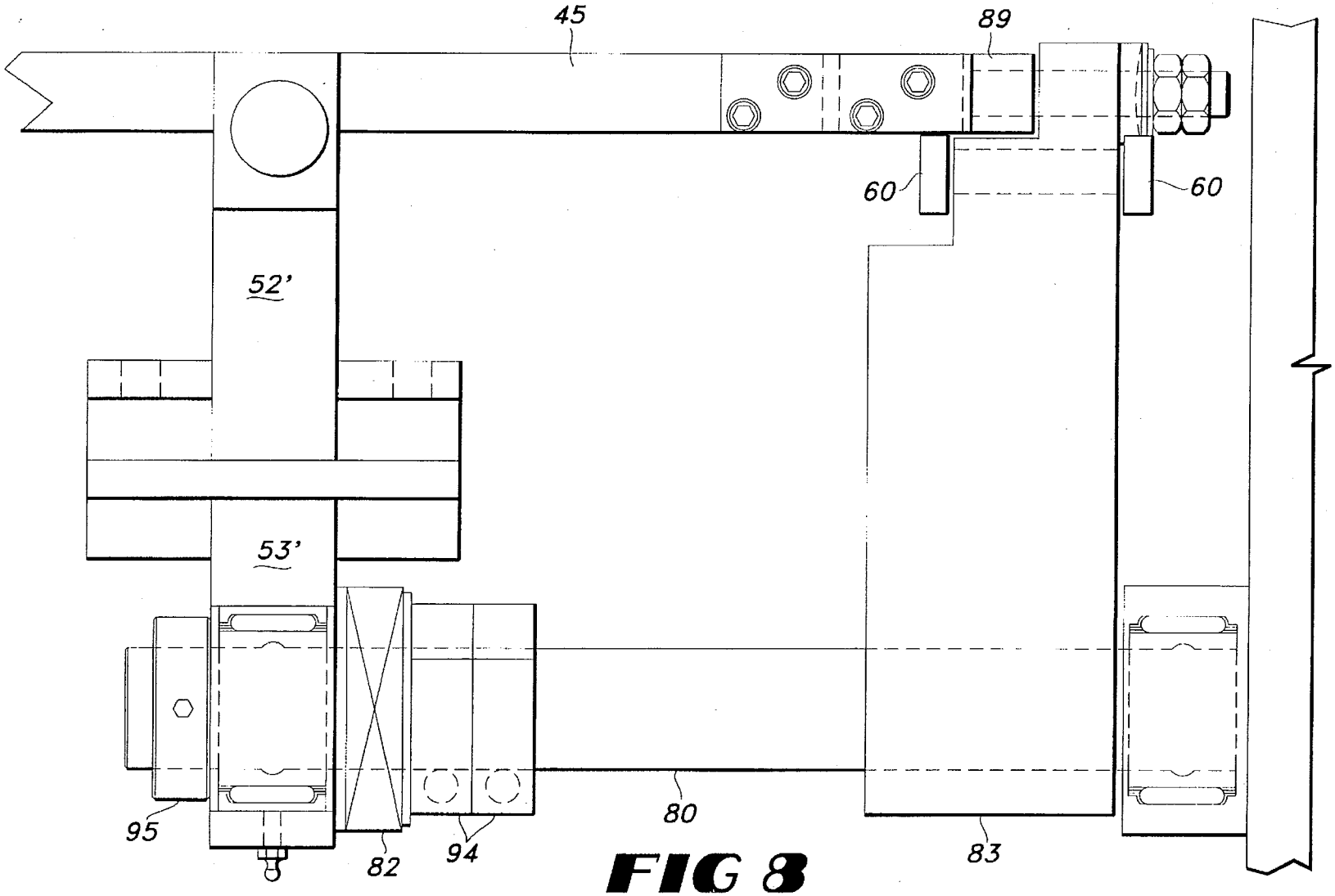
FIG. 8 is a side elevation view of the stub shaft construction described as an embodiment of this invention.

Accordingly, the present invention provides a tensioning means such as stub shaft 80 shown in FIGS. 5 and 8 to relieve the pressure placed on the hook bar 44. Such a tensioning means might alternatively comprise a tensioned cable attached to one end of the hook bar 44 or hook mounting bar 45, but has been preferably implemented by the addition of the illustrated stub shaft 80 fitted with a thrust bearing 82 as shown in FIG. 5. The preferred thrust bearings are rated at approximately 50,000 pounds and have grease fittings for easy maintenance. A linkage such as goose neck 83 connects the stub shaft 80 to the hook bar 44 thereby transmitting pressure from the thrust bearing 82 loaded stub shaft 80 to offset the tension from knives 65.

Turning in detail to the shaft assembly shown in FIG. 5, sections of knife shaft 70 and looper shaft 64 are illustrated. It will be understood that both such shafts extend the entire length of the tufting machine. Each bearing support block 51, 52 has knife shaft aperture 71 and looper shaft aperture 63. Apertures 71 and 63 are fitted with bearings 73. Within the bearings are liners 74 which receive the knife shaft 70 or looper shaft 64. Collars 75 hold these bearings in place.

Stub shaft 80 is fitted with liner 84 and bearing 85 and a first end 79 of said shaft 80, is inserted through aperture 81 in goose neck 83. End bearing block 86 is used to hold the stub shaft 80 and support bearing 85 in place. The opposite second end 78 of the stub shaft 80 is fitted with liner 91 and bearing 92 and second end of stub shaft 80 are secured with collar 95. Stub shaft 80 is also fitted with washer 93 and thrust bearing 82 and tensioned to supply sufficient pressure to offset the opposite tension applied by the knives 65.

As illustrated in FIG. 5, the upper portion of goose neck 83 has two apertures, 87, 88. The first of these apertures 87 receives a front pivot pin 58 which is connected by link pins 60 to a rear pivot pin 61 mounted in radial arm member 62. Radial arm member 62 is in turn mounted on driven looper shaft 64 as shown in FIG. 1. The rear pivot pin 61 is radially spaced from the rotary axis of the looper shaft 64 to impart linear motion to the goose neck 83 from the rotary motion of the looper shaft 64.

The second aperture 88 receives the post end of connecting link 89 which is secured by concave washers 38 and nuts 39. The opposite end of the connecting link 89 is fastened to hook mounting bar 45. In this fashion, tension from thrust bearing 82 is transmitted to hook mounting bar 45 and hook bar 44 sufficient to offset the opposite tension being applied to the hooks 41, 42 from knives 65 mounted in oppositely tensioned knife shaft 70. The result is that linear bearings 55 are able to reciprocate longitudinally without being subject to such substantial lateral tension as to cause early failure.

In the preferred embodiment, the goose neck 83 is driven off of the looper shaft 64 as described above, however, this is not an essential element of the invention. In order to minimize the change in height imparted to the connecting link 89 as the goose neck 83 reciprocably pivots radially about stub shaft 80 it is desirable to position aperture 88 which receives the post end of connecting link 89, directly above the center of the stub bar 80. In this fashion, when the goose neck 83 of the preferred length of about 10 inches rocks forward or backward by a distance of 0.25 inches, the variation in height of aperture 88 is only about 0.003 inches. This change in height is accommodated without damaging the hook mounting bar 45 or connecting link 89 by sizing the diameter of the post end of connecting link 89 about 0.03125 inches smaller than the diameter of aperture 88 and utilizing spherical or concave washers 38 to permit some room for vertical play in the connection.

It will be seen that the stub shaft 80 is to some extent analogous to a rocker shaft in a conventional cut pile tufting machine. Significantly, however, the stub shaft is positioned directly below the hook mounting bar 45, rather than below the needles 15, 16 as is a conventional rocker shaft. In addition, the stub shaft 80 only extends along a relatively short portion of the underside of the tufting machine. For instance, with a two inch diameter stub shaft 80, the distance between thrust bearing 82 and support bearing 85 is preferably about one foot. When this distance exceeds about three feet, there is a tendency for the stub shaft to bend. The preferred 10 inch length of goose neck 83 is also slightly longer than the 8.5 to 9.75 inch connection used with conventional rocker shafts.

Accordingly, it will be seen that an improved looper apparatus according to the present invention provides an assembly with less mass, minimizes vibration, provides for linear hook movement, and permits higher speed tufting machine operation. Perhaps most importantly, the improved looper apparatus provides a substantial open work space below the needle mounting plate 32 and between the knife shaft 70 and front portion of the machine from 50, extending all the way to the floor between cross members 53. This provides for much easier access to adjust and replace the operating components of the tufting machine.

Numerous alterations of the structure herein described will suggest themselves to those skilled in the art. It will be understood that the details and arrangements of the parts that have been described and illustrated in order to explain the nature of the invention are not to be construed as any limitation of the invention. All such alterations which do not depart from the spirit of the invention are intended to be included within the scope of the appended claims.

What is claimed is:

1. In a cut pile tufting machine having fabric support means for supporting a base fabric for longitudinal movement in a feeding direction through said machine, and a plurality of reciprocable needles for introducing yarns through the base fabric to form loops, the needles being spaced apart substantially transversely of the feeding direction, a looper apparatus comprising:

(a) a plurality of looper hooks, there being at least one looper hook for each needle, (b) a hook support member comprising an elongated hook bar extending transversely of said feeding direction and mounting looper hooks in at least the same transverse spaced relationship as the needles and adjacent said fabric support means, (c) said hook support member further comprising an elongated guide member having opposite ends, (d) linear bearing means supporting said guide member for linear reciprocable movement substantially parallel to said longitudinal feeding direction, (e) an elongated looper shaft, (f) rotary bearing means supporting said looper shaft transversely of said feeding direction for reciprocable rotary movement, (g) arm means projecting radially from said looper shaft, (h) connector means pivotally connecting said arm means to said hook support member to impart reciprocable linear movement to said looper hooks as said looper hooks move toward and away from said corresponding needles to form loops in the yarn carried through the base fabric by said needles, (i) a plurality of knives set in a knife mounting member and cooperating with and tensioned in a first lateral direction transverse to the feeding direction against a corresponding plurality of said looper hooks, and (j) a tensioning means in connection with the hook support member, applying tension in a second lateral direction opposite said first lateral direction.

2. The invention according to claim 1 in which said connector means comprises a link member having opposite ends, first means pivotally connecting one end of said link member to said arm means and second means pivotally connecting the other end of said link member to said hook support member.

3. The invention according to claim 2 in which said second means comprises pin means pivotally connecting said other end of said link member to said hook support member.

4. The invention according to claim 3 in which said link member comprises an elongated link bar having first and second ends, said first means comprising a first pivot pin pivotally connecting said first end of said link bar to said arm means at a radial distance from the axis of said looper shaft.

5. The invention according to claim 1 wherein said tensioning means comprises a linkage between the hook support member and a thrust bearing loaded stub shaft.

6. The invention according to claim 5 wherein the linkage comprises a goose neck.

7. The invention according to claim 5 wherein the thrust bearing loaded stub shaft is positioned substantially beneath the hook support member.

8. The invention according to claim 5 wherein the thrust bearing loaded stub shaft extends transversely to the feeding direction between a machine frame and a first cross member.

9. In a tufting machine having a frame, a plurality of transversely spaced horizontally reciprocable needles for introducing yarns through a base fabric to form loops, a plurality of transversely spaced hooks mounted in a vertically reciprocable hook bar and cooperative with said needles in a tufting area, a plurality of knives mounted upon a knife shaft and tensioned against said hooks, a tensioning means comprising:

a linkage extending between said hook bar and a thrust bearing loaded stub shaft mounted in the frame of the tufting machine.

10. The tufting machine according to claim 9 wherein the linkage comprises a goose neck.

11. The tufting machine according to claim 9 wherein the stub shaft is mounted transversely between the frame and a first cross member.

12. The tufting machine according to claim 9 wherein the base fabric is fed through the tufting machine from front to back, and an open space is provided in the tufting machine extending forward of the knife shaft to a front side of the frame and extending downward from the tufting area to a bottom edge of the frame.

13. The tufting machine according to claim 11 wherein the stub shaft is mounted in the frame substantially beneath the hook bar.

14. A tufting machine comprising:

(a) a frame having a head, a front side, a rear side, and two oppositely disposed end sides, in which are mounted a plurality of cross members.

(b) a reciprocably driven needle bar in the head of the machine supporting a plurality of transversely spaced yarn carrying needles;

(c) a fabric feed means for feeding a base fabric through the tufting machine from front to rear in a feeding direction beneath the needles and above a needle plate;

(d) a hook bar beneath the base fabric supporting a plurality of transversely spaced hooks cooperating with the needles to seize yarns and thereby form yarn loops on said hooks, said hook bar being supported by at least one linear bearing for reciprocable movement substantially parallel to the feeding direction;

(e) a knife bar supporting a plurality of knives tensioned against a plurality of the hooks for cutting the loops of yarn carried on said hooks, said knife bar being tensioned by at least one thrust bearing in a first lateral direction perpendicular to the feeding direction;

(f) a stub shaft mounted between one end side of the frame and a first cross member, wherein said stub shaft is tensioned in a second lateral direction opposite said first lateral direction by a thrust bearing;

(g) a linkage connecting and transmitting tension in said second lateral direction from the stub shaft to said hook shaft.

15. The tufting machine according to claim 14 wherein an open space is provided extending forward of the knife shaft to the front side of the frame and extending downward from the needle plate to a bottom edge of the frame.

16. The tufting machine according to claim 14 wherein the linkage comprises a goose neck.

* * * * *